United States Patent [19]

Hart

[11] Patent Number: 4,876,804

[45] Date of Patent: Oct. 31, 1989

[54] JUMPING SHOE

[76] Inventor: LeRoy Hart, 9340 NE. 76th St., Vancouver, Wash. 98662

[21] Appl. No.: 275,397

[22] Filed: Nov. 22, 1988

[51] Int. Cl.[4] ..... A43B 3/10

[52] U.S. Cl. ..... 36/7.8

[58] Field of Search ..... 36/7.8, 28, 116; 272/65, 114

[56] References Cited

U.S. PATENT DOCUMENTS

| | | | |
|---|---|---|---|
| 2,343,489 | 3/1944 | Westmaas | 36/7.8 |
| 4,336,933 | 6/1982 | Appelbaum | 272/65 |
| 4,707,934 | 11/1987 | Hart | 36/7.8 |

*Primary Examiner*—Werner H. Schroeder
*Assistant Examiner*—D. Biefeld
*Attorney, Agent, or Firm*—Kolisch, Hartwell & Dickinson

[57] ABSTRACT

An improved jumping shoe attachment is intended for use with a conventional shoe and includes a base, a shoe holder and plural shock cords which extend between the base and the shoe holder and which allow resilient, returnable vertical movemnt of the shoe holder relative to the base. The base includes top and bottom margins which are spaced from one another by a rigid, continuous wall extending therebetween. The shoe holder is constructed to receive a shoe thereon and includes straps for holding the shoe to the holder.

19 Claims, 2 Drawing Sheets

JUMPING SHOE

BACKGROUND OF THE INVENTION

This invention relates to jumping shoes, and particularly to an improved jumping shoe attachment which may be secured to a conventional shoe.

A variety of spring powered or biased shoes or shoe attachments are known. The complexity and stability of these attachments varies greatly and while some shoes are apparently useful for their intended purposes, others appear to present certain hazards to their users in that it would be quite difficult to maintain one's balance while using the shoe.

A more stable version of a jumping shoe attachment is disclosed in my U.S. Pat. No. 4,707,934, issued Nov. 24, 1987. Although the attachment disclosed in that patent overcomes many of the limitations of the prior art, additional improvements have been made thereto.

An object of the invention is to provide an improved jumping shoe attachment which may be secured to a conventional shoe and to overcome the drawbacks and limitations of the prior art. More specifically the invention has the following objects:

(1) to provide a shoe attachment which will provide a trampoline-like movement for the wearer;

(2) to provide a shoe attachment which includes a base having sufficient structural integrity to support users of varying weight;

(3) to provide a shoe attachment which includes a traction enhancing foot pad at the base thereof; and (4) to provide a shoe attachment which is easy and inexpensive to manufacturer and which is easily used by a wearer.

SUMMARY OF THE INVENTION

The improved jumping shoe attachment of the invention is intended for use with a conventional shoe and includes a base, a shoe holder and plural shock cords which extend between the base and the shoe holder and which allow resilient, returnable vertical movement of the shoe holder relative to the base. The base has top and bottom margins which are spaced from one another by a rigid, continuous wall extending therebetween. The shoe holder is constructed to receive a shoe thereon and includes traps for holding the shoe to the holder.

These and other objects and advantages of the invention will become more fully apparent as the description which follows is read in conjunction with the drawings.

DETAILED DESCRIPTION OF THE PREFERRED EMBODIMENT

Figure 1:
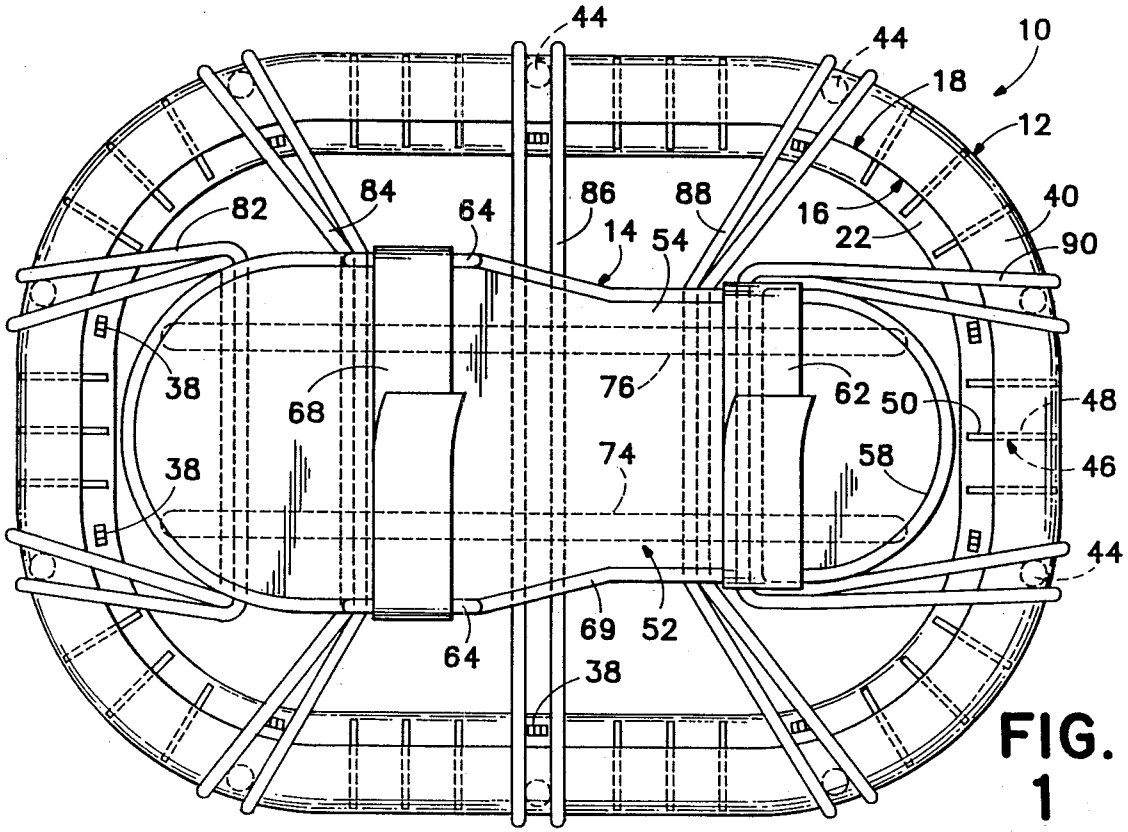
FIG. 1 is a top plan view of an improved jumping shoe attachment constructed according to the invention.

Referring now to the drawings, an improved jumping shoe attachment constructed according to the invention is depicted generally at 10. Attachment 10 includes a base, which is depicted generally at 12, and a shoe holder, or shoe holder means, depicted at generally at 14.

Base 12, in the preferred embodiment, includes a hollow, generally oval wall 16 which is rigid and extends continuously about the periphery of the base. Wall 16 is generally vertically disposed. The base has a top margin 18 at the upper edge of wall 16, and a bottom margin 20 at the lower edge of the wall. Both margins have a generally oval, or race track, form of predetermined size. In the preferred embodiment, the periphery of the margins are of equal size although the bottom margin may, in some instances, have a slightly larger periphery, forming an outward, downward slope between the top and bottom margins.

Figure 2:
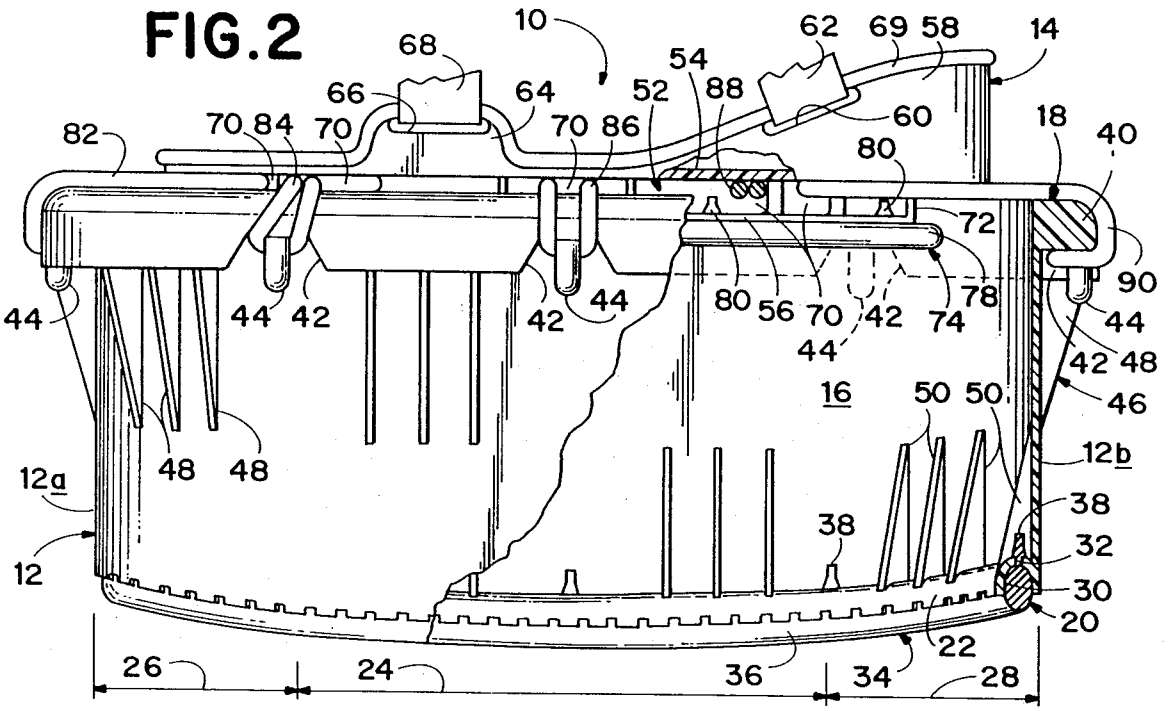
FIG. 2 is a side view of the shoe attachment of FIG. 1, with portions broken away to show detail.

Bottom margin 20 has a rib 22 disposed about the periphery thereof. In the depicted embodiment, rib 22 extends inward from wall 16. Rib 22 and bottom margin 20 are formed with a curved, or rockered, lower surface. This lower surface is formed with a smooth curve along a majority of its length, as depicted in FIG. 2 by arrow 24. The lower surface than has an increased curve between the distances indicated by arrow 26 at the forward end **12*a* of base 12 and arrow 28 at the rear end 12*b* of the base. Rib 22 and bottom margin 20** are formed with a series of dental-like notches extending about the periphery thereof.

A groove 30 is formed in rib 22 and bottom margin 20 about the periphery of the bottom margin. Groove 30 opens downward relative to base 12. A series of ports 32 are distributed about rib 22 in communication with groove 30.

A resilient, traction enhancing foot pad 34 is received in groove 24. Pad 34 extends below bottom margin 20 and provides contact between a surface and shoe attachment 10. Pad 34 includes a surface contacting portion 36 and plural tabs 38, which are integrally formed with contacting portion 36, and which extend through ports 32, thereby securing the foot pad to the base. In the preferred embodiment, foot pad 34 is formed in four sections, each of which extends approximately one-quarter of the distant about the periphery of bottom margin 20, thereby forming a substantially continuous structure about the periphery of the bottom margin.

An upper flange 40 extends about the periphery of top margin 18 outwardly therefrom. Flange 40 has a series of notches 42 formed in the lower surface thereof. In each notch, a pin 44 extends downward from the lower surface of the flange and provides what is referred to herein as shock cord retaining means or shock cord retainer.

Wall 16 is provided with plural braces 46 extending about the periphery thereof. Each brace includes an outer portion 48 which extends between the lower surface of flange 40 and wall 16 and an inner portion 50 which extends between rib 22 and the inner surface of wall 16. As depicted in FIG. 2, the inner and outer portions of the brace overlap on opposite sides of the wall to provide additional stiffening to wall 16.

Referring now to FIGS. 1 and 2, shoe holder 14 will be described in greater detail. Shoe holder 14, also referred to herein as holder means, is provided to retain a shoe on attachment 10. In the preferred embodiment, holder 14 includes a semi-rigid platform 52 which has an upper, shoe-sole contacting surface 54 and a lower surface 56. A heel receptacle 58 is formed at the rear of holder 14 to retain the heel of a user's shoe therein. Receptacle 58 has slots 60 formed therein which receive a strap 62 therethrough. Strap 62 is operable to secure the shoe holder to a user's shoe. An instep flange 64 is located adjacent the forward end of holder 14 on either side thereof. A slot 66 is formed in flange 64 and receives a strap 68 therethrough. Strap 68 provides a second point for securing the shoe holder to the user's shoe. A ridge 69 extends about the periphery of holder 14.

Plural shock cord receivers, or receiver means 70 are located between upper surface 54 and lower surface 56 of platform 52. In the preferred embodiment, eight such receivers are provided, arranged in four sets of two, as depicted in FIG. 1. Receivers 70 have curved surfaces to reduce wear on the shock cords received therein. Additional supports 72 are located between upper surface 54 and lower surface 56 to provide rigidity and strength to platform 52.

A pair of bumpers 74, 76 extend along lower surface 56 of shoe holder 14. The bumpers include a shock-absorbing portion 78 and tabs 80, which pass through lower surface 56 and secure the bumper to the shoe holder.

Resilient means extend between base 12 and shoe holder 14. In the preferred embodiment, resilient means takes the form of plural shock cords 82, 84, 86, 88 and 90. The cords are continuous loops of resilient material, such as latex rubber. The shock cords may alternately be constructed from bungy-cord material. The cords are affixed to pins 44 and are trained through receivers 70 on shoe holder 14. As depicted in FIG. 2, the end shock cords 82, 90 are fixed to pins at the ends of base 12 to provide fore and aft positioning of shoe holder 14. Middle shock cord 86 extends directly across the width of base 12 and through platform 52. The intermediate shock cords 84, 88 extend through receivers 70 and are disposed slightly forward and aft, respectively, of their respective receivers. Shock cords 82–90 are operable to maintain holder 14 on base 12 at a level with that of top margin 18. The shock cords allow relative, resilient vertical movement of shoe holder 14 relative to the base and provide return of the shoe holder to its at-rest position, which is depicted in FIG. 1.

When the shoe attachment of the invention is to be used, the feet of the user are placed on shoe holders 14 and attachment 10 is secured by means of straps 62, 68. The placing of the user's weight on holders 14 causes the holders to be depressed vertically downward, stretching the shock cords, thereby lowering the shoe holders to a level below that of top margin 18. The user then generates appropriate body movement to produce vertically upward motion of the user's body with the result that the shock cords are relaxed. The shoe holders return to the at-rest position momentarily and then rise to a position above the level of the top margin. With appropriate user leg motion, shoe attachments 10 will be lifted off of the surface with upward motion of the user's body. Repeated up and down motion of user's body will result in a trampoline-like action which provides exercise to the user's body.

A feature of the invention is the easy removal of one set of shock cords and installation of a set of shock cords having a greater or lesser modulus of elasticity. A set of shock cords which are suitable for use by an adult would not be suitable for use by a child, or by another adult whose weight was significantly different than that for which the first set of shock cords was intended. For this reason, the shock cords may be replaced to provide chords suitable for individuals of varying weight.

The curved lower surface of bottom margin 20 facilities walking or jogging with the attachments secured to the user's feet. The rockered curvature of the lower surface allows for the user to maintain a more natural stride when the attachments are worn.

Foot pads 34 provide enhanced friction and also prevent damage to floor surfaces if the attachment is used indoors. Bumpers 74, 76 prevent damage to floor surfaces and holders 14 in the event a holder is fully depressed to the level of bottom margin 20.

Although a preferred embodiment of the invention has been disclosed herein it should be appreciated that variations and modification may be made thereto without departing from the scope of the invention as defined in the appended claims.

It is claimed and desired to secure as Letters Patent:

1. An improved jumping shoe attachment for use with a shoe comprising:

a base having spaced apart top and bottom margins and a rigid, continuous, peripherally extending wall extending between the margins;

a shoe holder for receiving a shoe thereon including straps for holding the shoe to the holder; and resilient means extending in tension between said base and said shoe holder allowing resilient, returnable vertical movement of said shoe holder relative to said base.

2. The jumping shoe attachment of claim 1 wherein said base includes retainers for said resilient means which are spaced about the top margin thereof.

3. The jumping shoe attachment of claim 1 wherein said top margin includes an outward projecting flange about the periphery thereof, and wherein said retainers for said resilient means include plural, downward facing pins distributed on the lower side of said flange.

4. The jumping shoe attachment of claim 1 wherein said resilient mean includes plural shock cords.

5. The jumping shoe attachment of claim 4 wherein each shock cord includes a continuous loop of resilient material.

6. The jumping shoe attachment of claim 1 wherein said base includes a downward facing groove about the bottom margin thereof and which further includes a resilient, traction enhancing foot pad received in said groove.

7. The jumping shoe attachment of claim 6 wherein said base has spaced apart forward and rear ends and wherein said bottom margin is upwardly curved at said ends.

8. The jumping shoe attachment of claim 1 wherein said shoe holder includes a platform having an upper, shoe-sole contacting surface, a lower surface and having shock cord receivers disposed between said upper surface and said lower surface, and shock-absorbing material extension downwardly from said lower surface.

9. An improved jumping shoe attachment for use with a shoe comprising:

a base having spaced apart top and bottom margins, a rigid, continuous wall extending between the margins, and shock cord retainers distributed about said top margin;

shoe holder means for retaining a shoe thereon, said holder means including shock cord receivers thereon; and plural shock cord means extending between said retainers and said receivers for maintaining said shoe holder means on said base at a level with that of said top margin and for allowing relative, vertical movement between said base and said holder means.

10. The jumping shoe attachment of claim 9 wherein said top margin includes an outward projecting flange about the periphery thereof, and wherein said shock cord retainers include plural, downward facing pins distributed on the lower side of said flange.

11. The jumping shoe attachment of claim 9 wherein each shock cord means includes a continuous loop of resilient material.

12. The jumping shoe attachment of claim 9 wherein said base includes a downward facing groove about the bottom margin thereof and which further includes a resilient, traction enhancing foot pad received in said groove.

13. The jumping shoe attachment of claim 9 wherein said shoe holder includes a semi-rigid platform having an upper, shoe-sole contacting surface and a lower surface, and wherein said shock-cord receivers are located between said upper surface and said lower surface.

14. The jumping shoe attachment of claim 9 wherein said base has spaced apart forward and rear ends and wherein said bottom margin is upwardly curved at said ends.

15. An improved jumping shoe attachment for use with a shoe comprising:

a base having spaced apart top and bottom margins and spaced apart forward and rear ends, said top and bottom margins having a generally oval shaped periphery of predetermined size, an outwardly projecting flange about the periphery of said top margin with spaced, downwardly projecting pins distributed thereabout, and a rigid, peripheral wall extending between said top margin and said bottom margin;

a shoe holder for receiving a shoe thereon including straps for holding the shoe to the holder and plural, shock-cord receivers; and plural shock cords extending between said pins and said shock cord receivers allowing resilient, returnable vertical movement of said shoe holder relative to said base.

16. The jumping shoe attachment of claim 15 wherein each shock cord includes a continuous loop of resilient material.

17. The jumping shoe attachment of claim 15 wherein said base includes a downward facing groove about the bottom margin thereof and which further includes a resilient, traction enhancing foot pad received in said groove.

18. The jumping shoe attachment of claim 15 wherein said bottom margin is upwardly curved at the ends of said base.

19. The jumping shoe attachment of claim 15 wherein said shoe holder includes a semi-rigid platform having an upper, shoe-sole contacting surface.

* * * * *